US008927893B2

(12) United States Patent
Kim

(10) Patent No.: US 8,927,893 B2
(45) Date of Patent: Jan. 6, 2015

(54) DRIVER FOR SWITCH IN GAS INSULATED SWITCHGEAR AND GAS INSULATED SWITCHGEAR HAVING THE SAME

(75) Inventor: Hyung Choon Kim, Ulsan (KR)

(73) Assignee: Hyundai Heavy Industries Co., Ltd., Ulsan (KR)

( * ) Notice: Subject to any disclaimer, the term of this patent is extended or adjusted under 35 U.S.C. 154(b) by 274 days.

(21) Appl. No.: 13/591,365

(22) Filed: Aug. 22, 2012

(65) Prior Publication Data

US 2013/0168358 A1 Jul. 4, 2013

(51) Int. Cl.

| | |
|---|---|
| ***H01H 33/02*** | (2006.01) |
| ***H01H 33/40*** | (2006.01) |
| ***H01H 3/40*** | (2006.01) |
| ***H01H 3/42*** | (2006.01) |
| ***H01H 33/36*** | (2006.01) |

(52) U.S. Cl.

CPC ..... *H01H 33/40* (2013.01); *H01H 3/40* (2013.01); *H01H 3/42* (2013.01); *H01H 33/36* (2013.01)

USPC ..... 218/154; 218/72

(58) Field of Classification Search

USPC ..... 218/78, 154

See application file for complete search history.

(56) References Cited

U.S. PATENT DOCUMENTS

| | | | | |
|---|---|---|---|---|
| 4,095,676 | A * | 6/1978 | Howe et al. | 185/40 R |
| 4,681,993 | A * | 7/1987 | Kondo et al. | 200/560 |
| 5,113,056 | A * | 5/1992 | Kuhn | 200/400 |
| 5,981,889 | A * | 11/1999 | Niklaus | 200/501 |
| 6,472,627 | B1 * | 10/2002 | Yoon | 200/400 |
| 6,545,241 | B1 * | 4/2003 | Franchi et al. | 218/78 |
| 6,809,279 | B2 * | 10/2004 | Allmen | 200/501 |
| 6,831,244 | B2 * | 12/2004 | Kawamoto et al. | 218/78 |
| 7,186,937 | B1 * | 3/2007 | Ricciuti et al. | 200/400 |
| 8,779,318 | B2 * | 7/2014 | Espeseth et al. | 218/124 |

FOREIGN PATENT DOCUMENTS

KR 10-20110089529 9/2011

* cited by examiner

*Primary Examiner* — Truc Nguyen
(74) *Attorney, Agent, or Firm* — Sherr & Jiang, PLLC

(57) ABSTRACT

A driver for a switch in a GIS (Gas Insulation Switchgear) includes a motor, a shaft connected with a moving contact of the switch, a gear connected with one terminal of the shaft and configured to transfer power of the motor to cause the shaft to reciprocate the moving contact through the shaft, a cam spline combined with the shaft and spaced apart from the gear, and a micro-switch connected with the cam spline and configured to control an operation of the motor.

7 Claims, 7 Drawing Sheets

300

DRIVER FOR SWITCH IN GAS INSULATED SWITCHGEAR AND GAS INSULATED SWITCHGEAR HAVING THE SAME

CROSS-REFERENCE TO RELATED APPLICATIONS

This application claims foreign priority under 35 U.S.C. §119 to Korean Patent Application No. 10-2011-0089529 filed Sep. 5, 2011 with the Korean Intellectual Property Office, which is hereby incorporated by reference in its entirety.

BACKGROUND OF THE INVENTION

1. Field of the Invention

The present invention relates to a driver for a switch in a GIS (Gas Insulated Switchgear) and more particularly, to a driver capable of precisely controlling a moving contact in a switch regardless of play and skewness in components.

2. Description of the Related Art

In an electric power system, switchgear, especially GIS (Gas Insulated Switchgear), is used for a power plant or a substation. In fault conditions, such as short circuits and overload fault currents, the switchgear provides isolation of circuits from power supplies to protect power systems while maintaining service to unaffected circuits.

In general, the switchgear may include a circuit breaker, a current transformer, a ground switch, a disconnecting switch, 3-position switch, a driver and so on. The disconnecting switch may open or close circuits and the ground switch categorized into, but not limited to, a repair ground switch and a high speed ground switch may ground the circuits after the circuits are opened. The 3-position switch may open, close or ground the circuits. The disconnecting switch, the ground switch or the 3-position switch (hereinafter, referred to as "switch") may include a moving contact and a fixing contact.

The driver may be directly connected with the switch or may be indirectly connected with the switch by means of at least one of a link, a gearbox, and a lever, so that the driver reciprocates the moving contact in the switch to open or close the circuits.

However, when the driver is located far from the switch, the moving contact in the switch is not precisely controlled and the power transfer by the driver may be lost due to play and skewness in components such as combinations of links, gearboxes and levers. Therefore, the driver may be located near to the switch.

Also, when the driver is mounted on the upper portion of the GIS, a worker may need to go up a ladder to the driver for operation, which will result in inconvenience and possibly accidents.

This related technology is disclosed in the Korean patent publication NO. 10-2009-0072580.

SUMMARY OF THE INVENTION

To address the above-discussed problems occurring in the prior art, one aspect of the present invention is to provide a driver capable of precisely controlling a moving contact in a switch regardless of play and skewness in components.

Another aspect of the present invention is to provide a GIS (gas insulated switchgear) having a driver capable of precisely controlling a moving contact in a switch regardless of play and skewness in components.

In some embodiments, a driver for a switch in a GIS (Gas Insulation Switchgear) includes a motor, a shaft being connected with a moving contact of the switch, a gear being connected with one terminal of the shaft and configured to transfer power of the motor to cause the shaft to reciprocate the moving contact through the shaft, a cam spline being combined with the shaft and being space apart from the gear, and a micro-switch being connected with the cam spline and configured to control an operation of the motor.

In one embodiment, the motor may be remote from the gear so that the motor indirectly transfers its power to the gear. The micro-switch may be located outside an enclosure enclosing the disconnecting switch, the ground switch or the 3-position switch.

The driver may further include an auxiliary switch being connected with the gear and configured to auxiliarily control the operation of the motor.

The switch may correspond to a disconnecting switch, a ground switch or a 3-position switch. In one embodiment, the shaft may correspond to an insulation shaft projected from an enclosure enclosing the disconnecting switch, the ground switch or the 3-position switch. In another embodiment, the shaft may correspond to a grounded metal shaft projected from an enclosure enclosing the disconnecting switch, the ground switch or the 3-position switch.

In some embodiments, a GIS (Gas Insulation Switchgear) includes a driver for a disconnecting switch, a ground switch or a 3-position switch. The driver includes a motor, a shaft being connected with a moving contact of the disconnecting switch, the ground switch or the 3-position switch, and configured to receive power of the motor to reciprocate the moving contact, a cam spline being combined with the shaft, and a micro-switch being connected with the cam spline and configured to control an operation of the motor.

Accordingly, a driver and associated technologies according to exemplary embodiments of the present invention may precisely control a moving contact in a switch regardless of play and skewness in components. For this, the driver may include a cam spline in a shaft and a micro-switch to output an electrical signal in a precise position.

A driver and associated technologies according to exemplary embodiments of the present invention may connect a moving and fixing contacts up to a precise point regardless of loss of rotational movements due to play and skewness in components.

A driver and associated technologies according to exemplary embodiments of the present invention may precisely measure a rotation amount with a cam spline in spite of play and skewness in components.

DETAILED DESCRIPTION OF THE INVENTION

Figure 1:
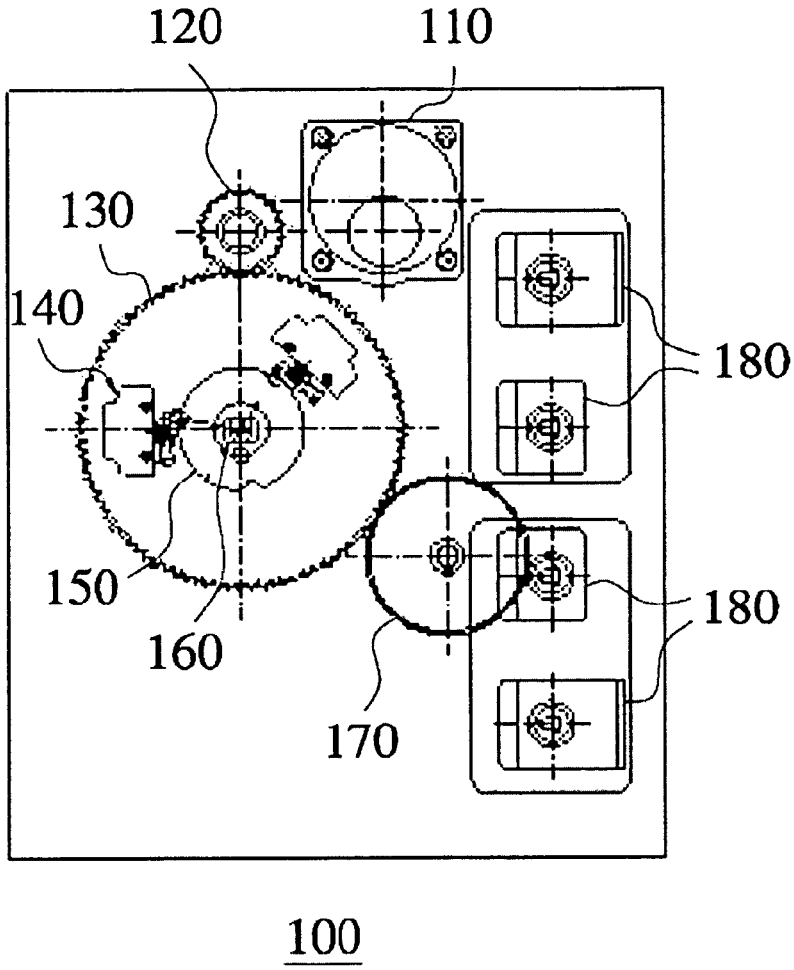
FIG. 1 is a diagram illustrating a conventional driver in a GIS (Gas Insulated Switchgear).

Reference will now be made in greater detail to a non-limiting, exemplary embodiment of the invention, an example of which is illustrated by the accompanying drawings.

Since descriptions of the disclosed technology are only presented to describe embodiments whose purpose is to describe the structures and/or functions of the present invention, it should not be concluded that the scope of the rights of the disclosed technology is limited by the embodiments described herein. That is, the embodiments may be modified in various ways and, therefore, it should be understood that the scope of the rights of the disclosed technology may include equivalents which can implement the technical spirit of the present invention. Furthermore, since objects or advantages presented in connection with the disclosed technology do not require that a specific embodiment should fulfill all of them or only one of them, it should not be concluded that the scope of the rights of the disclosed technology is limited by the presented objects and advantages.

Meanwhile, the meanings of terms described herein should be construed as follows:

The terms "first" and "second" are only used to distinguish one element from another element, and the scope of the rights of the disclosed technology should not be limited by these terms. For example, a first element may be designated as a second element, and similarly the second element may be designated as the first element.

When it is described that one element is "connected" or "coupled" to another element, the one element may be directly connected or coupled to another element, but an intervening element may exist therebetween. On the other hand, when it is described that one element is "directly connected" or "directly coupled" to another element, it should be understood that no element exists therebetween. Meanwhile, other expressions which describe the relationships between elements, that is, "between ~" and "directly between ~" or "adjacent to ~" and "directly adjacent to ~," should be interpreted in the same way.

It should be understood that a singular expression may include a plural expression, as long as the context of the expressions is not obviously different. In this application, the meaning of "include" or "have" are intended to specify a property, a fixed number, a step, a process, an element, a component, and/or a combination thereof but are not intended to exclude the presence or addition of other properties, fixed numbers, steps, processes, elements, components, and/or combinations Reference characters (for example, a, b, c, etc.) related to steps are used for convenience of description, and are not intended to describe the sequence of the steps. The steps may occur in different sequences, as long as a specific sequence is not specifically described in the context. That is, the steps may occur in a specified sequence, may occur simultaneously, or may be performed in the reverse sequence.

All the terms used herein have the same meanings as terms that are generally understood by those having ordinary knowledge in the art to which the disclosed technology pertains, as long as the terms are defined differently. It should be understood that the terms defined in generally-used dictionaries have meanings coinciding with those of terms in the related technology.

FIG. 1 is a diagram illustrating a conventional driver in a GIS (Gas Insulated Switchgear).

Referring to FIG. 1, a driver 100 includes a geared motor 110, a first gear 120, a second gear 130, a micro-switch 140, a cam 150, a shaft 160, a third gear 170 and an auxiliary switch 180.

In the driver 100, when the geared motor 110 starts rotating, the components receive power of the geared motor 110. In FIG. 1, the second gear 130 is connected with the geared motor 110 and is integrated with the cam 150 and the shaft 160 by means of axis connection.

The micro-switch 140 is installed for controlling the geared motor 110. The cam 150 forms a groove or protrusion in a predetermined rotation angle for shutting off power of the geared motor 110.

Figure 2:
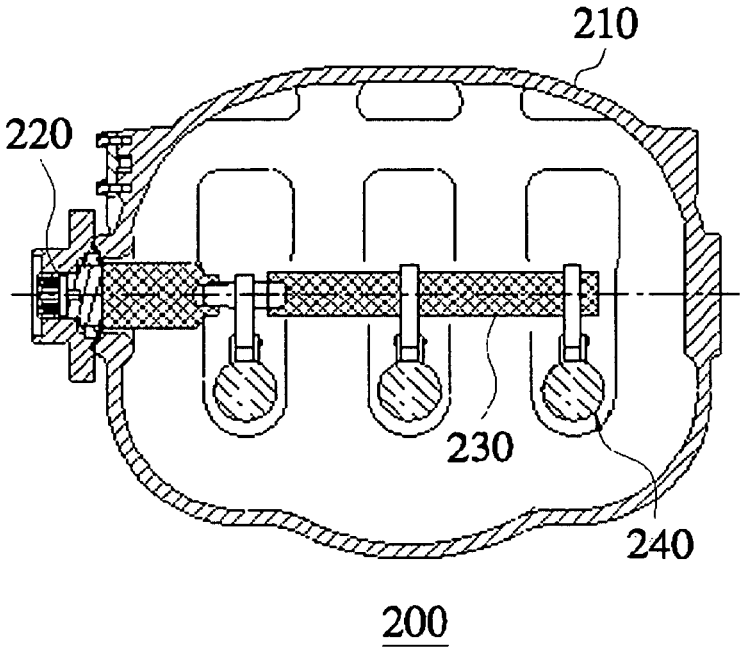
FIG. 2 is a sectional diagram illustrating a switch connected with a driver in FIG. 1.

The shaft 160 extends to an enclosure of a switch and is connected with a moving contact of the switch to close or open a circuit (described in FIG. 2). Herein, the circuit is open when the moving contact is not connected with a fixing contact and the circuit is close when the moving contact is connected with the fixing contact. The switch may correspond to a disconnecting switch, a ground switch or a 3-position switch in the GIS. The disconnecting switch and the ground switch may include a moving contact and the 3-position switch may include two moving contacts.

The auxiliary switch 180 is connected with the shaft 160 via a mechanical motion (e.g., gear motion, chain motion, linkage motion and so on) to output an electrical signal for satisfying customers' needs. Herein, when a configuration (i.e., shape or position) of the groove or protrusion in the cam 150 is not accurate or the micro-switch 140 inaccurately operates, the moving contact in the switch may not be precisely connected with the fixing contact, and thus an accident by incomplete connection or damage therebetween may occur. This requires precise rotation of the shaft 160 and precise setting of the micro-switch 140 and the cam 150.

The driver 100 is directly connected with the enclosure or indirectly connected via a short linkage with the enclosure. That is, play and skewness between the shaft 160 and a component (e.g., another shaft) in the enclosure should be minimized for precise rotation.

FIG. 2 is a sectional diagram illustrating a switch connected with the driver in FIG. 1.

Referring to FIG. 2, the switch 200 includes an enclosure 210, a first insulation shaft 220, a second insulation shaft 230 and a point of contact 240. The switch 200 may correspond to a disconnecting switch, a ground switch or a 3-position switch in the GIS.

The switch 200 is driven by the driver 200. That is, the first and second insulation shafts 220 and 230 may open or close the point of contact 240. The point of contact 240 may be opened or closed with the moving and fixing contacts.

Figure 3A:
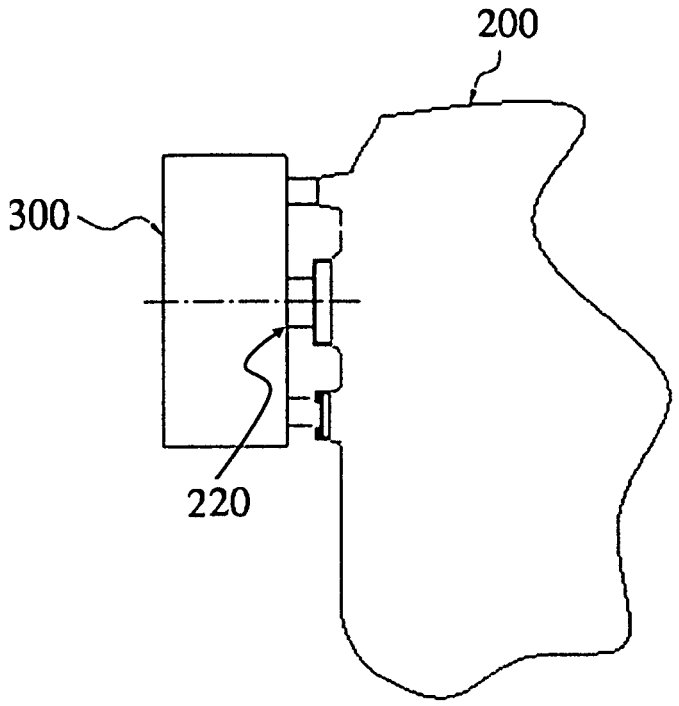
FIGS. 3*a* through 3*c* are diagrams illustrating arrangement relationship between a driver and a switch.
Figure 3B:
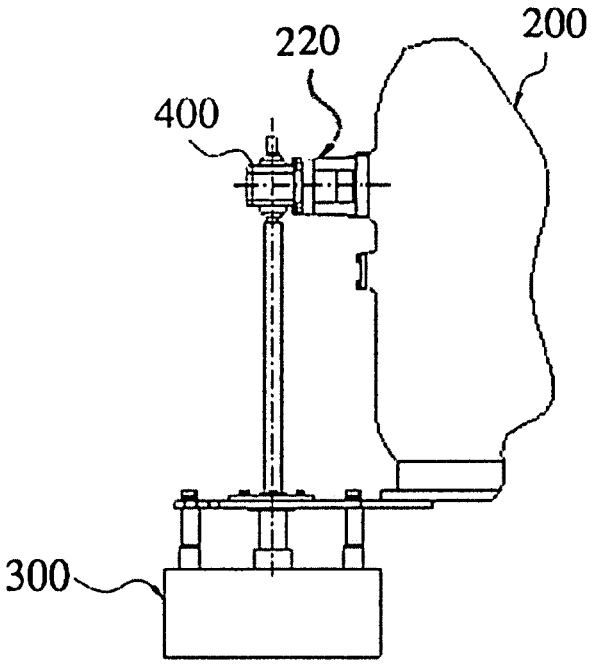
Figure 3C:
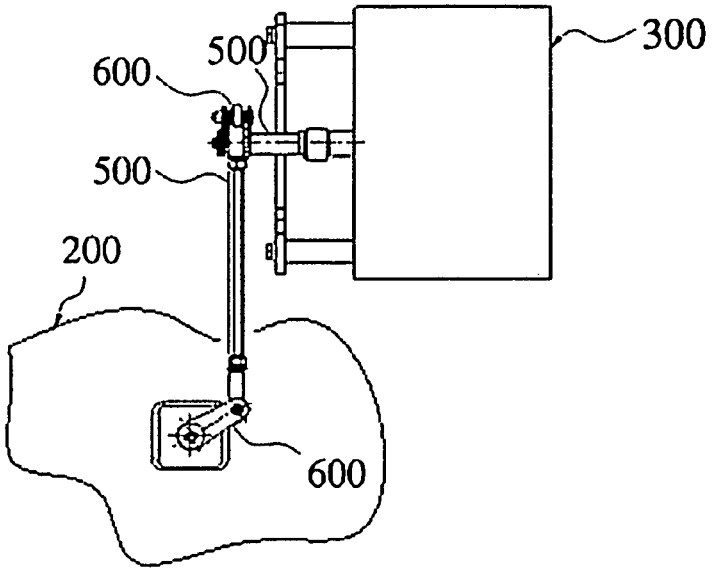

FIGS. 3*a* through 3*c* are diagrams illustrating arrangement relationship between a driver and a switch.

In FIGS. 3*a* through 3*c*, a switch 200 and a driver 300 may be arranged in various forms. For example, in FIG. 3*a*, the driver 300 may be directly connected with an insulation shaft 220 of the switch 200. For another example, in FIG. 3*b*, the driver 300 may be indirectly connected, through a direction change gearbox 400 (e.g., bevel gear), with an insulation shaft 220 of the switch 200. For still another example, in FIG. 3*c*, the driver 300 may be indirectly connected, through links 500 and levers 600, with an insulation shaft 220 of the switch 200.

Play and skewness in components of FIG. 3*a* may be the smallest. Architecture flexibility and work convenience in components of FIG. 3*c* may be the best.

Figure 4:
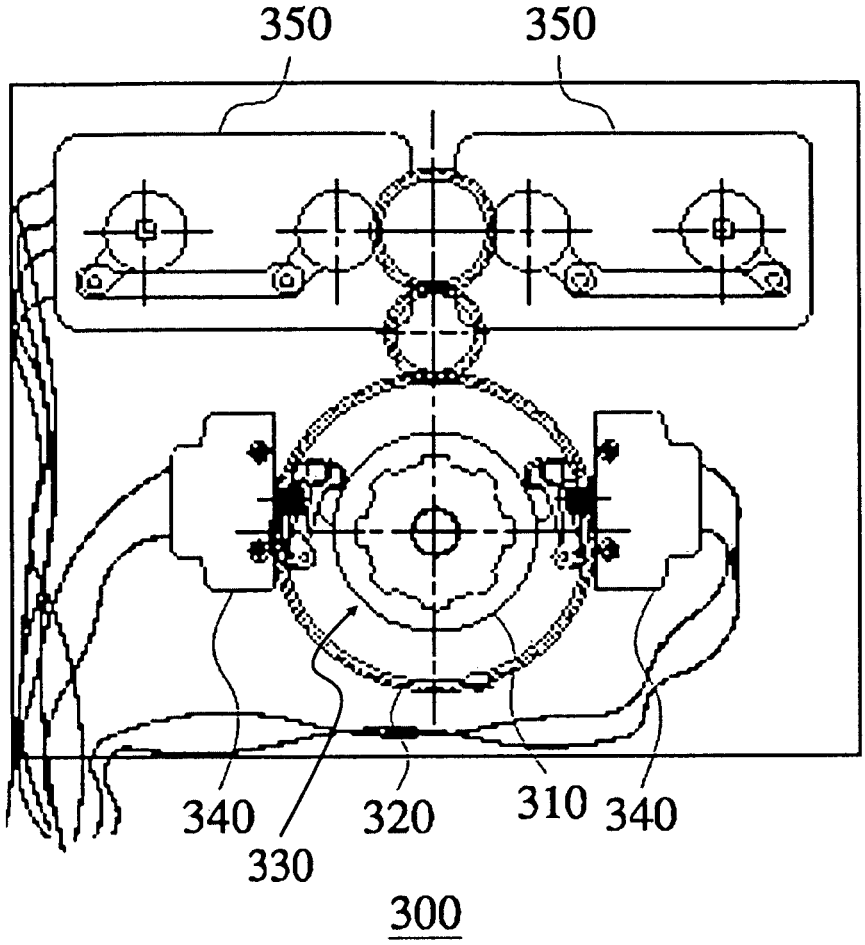
FIGS. 4 and 5 is a diagram illustrating a driver for a switch in FIGS. 3*a* through 3*c*.
Figure 5:
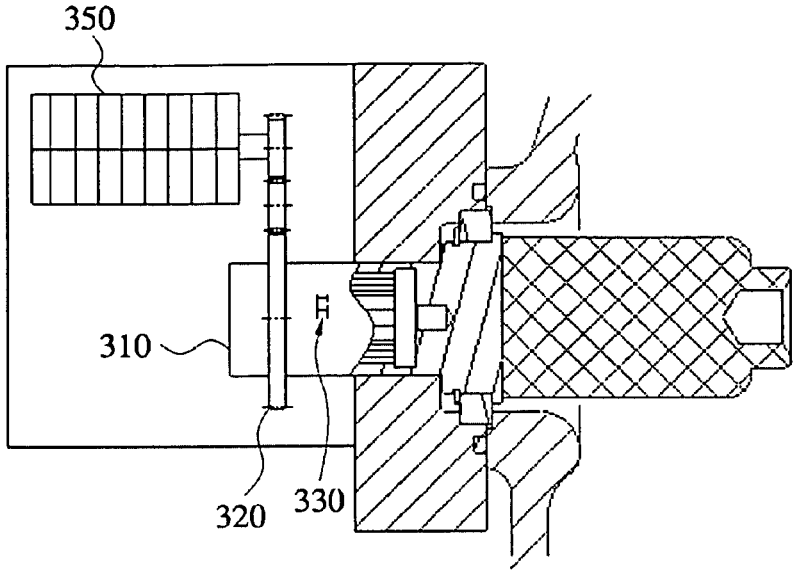

FIGS. 4 and 5 is a diagram illustrating a driver for a switch in FIGS. 3*a* through 3*c*.

Referring to FIGS. 4 and 5, the driver 300 includes a shaft 310, a gear 320, a cam spline 330, a micro-switch 340 and an auxiliary switch 350.

The motor 110 (FIG. 1) may be remotely and indirectly connected with the shaft 310. The shaft 310 is connected with a moving contact of the switch 200 and may be connected with the motor 110 by means of axis connection. The gear 320 is connected with one terminal of the shaft 310 and transfers power of the motor 110 to cause the shaft 310 to reciprocate the moving contact through the shaft 310.

In one embodiment, the shaft 310 may correspond to an insulation shaft or a grounded metal shaft projected from an enclosure enclosing the switch 200. The switch 200 may correspond to a disconnecting switch, a ground switch or a 3-position switch in the GIS.

The motor may be remote from the gear 320 so that the motor 110 indirectly transfers its power to the gear 320 and the shaft 310 may be directly connected with the enclosure of the switch 200.

The cam spline 330 is combined with the shaft 310 and is space apart from the gear 320. The cam spline 330 is used for measuring rotation angle of the shaft 310. The micro-switch 340 is connected with the cam spline 330 and controls an operation of the motor 110 with the measured rotation angle. That is, the micro-switch 340 controls power of the motor 110 remote from the gear 320.

In one embodiment, the micro-switch 340 may be located outside the enclosure enclosing the switch 200. In one embodiment, the micro-switch 340 may be plural and may be located in both sides of the cam spline 330.

The auxiliary switch 350 is connected with the gear 320 and auxiliarily controls the operation of the motor 110. In one embodiment, the auxiliary switch 350 may be connected with the gear 320 and may output an auxiliary signal generated based on rotation of the gear 320 to the motor 110 regardless of the micro-switch 340.

In the above, the driver 300 adopts the shaft 310 combined with the cam spline 330 and the motor 110 remote from the gear 320 to increase architecture flexibility, work convenience and reliability without regard to play and skewness in components.

That is, the driver 300 may connect the moving and fixing contacts up to a precise point regardless of loss of rotational movements due to play and skewness in components. The driver 300 may precisely measure a rotation amount with a cam spline in spite of play and skewness in components.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A driver for a switch in a GIS (Gas Insulation Switchgear), the driver comprising:

a motor;

a shaft driven by the motor and connected with a moving contact of the switch;

a gear installed on one terminal of the shaft and configured to transfer power of the motor to cause the shaft to reciprocate the moving contact through the shaft;

a cam spline combined with the shaft and spaced apart from the gear;

a micro-switch connected with the cam spline and configured to control an operation of the motor; and an auxiliary switch connected with the gear, wherein the micro-switch is located outside an enclosure enclosing a disconnecting switch, a ground switch, or a 3-position switch, wherein the shaft, the gear, and the cam spline are coaxially installed.

2. The driver of claim 1, wherein the motor is remote from the gear so that the motor indirectly transfers the power to the gear.

3. The driver of claim 1, wherein the auxiliary switch is configured to auxiliarily control the operation of the motor.

4. The driver of claim 1, wherein the switch corresponds to a disconnecting switch, a ground switch or a 3-position switch.

5. The driver of claim 4, wherein the shaft corresponds to an insulation shaft projected from an enclosure enclosing the disconnecting switch, the ground switch or the 3-position switch.

6. The driver of claim 4, wherein the shaft corresponds to a grounded metal shaft projected from the enclosure enclosing the disconnecting switch, the ground switch or the 3-position switch.

7. A GIS (Gas Insulation Switchgear) comprising:

a driver for a disconnecting switch, a ground switch or a 3-position switch, wherein the driver includes a motor, a shaft driven by the motor and connected with a moving contact of the disconnecting switch, the ground switch or the 3-position switch, and configured to receive power of the motor to reciprocate the moving contact, a gear installed on one terminal of the shaft and configured to transfer power of the motor to cause the shaft to reciprocate the moving contact, a cam spline combined with the shaft, a micro-switch connected with the cam spline and configured to control an operation of the motor, and an auxiliary switch connected with the gear, wherein the micro-switch is located outside an enclosure enclosing the disconnecting switch, the ground switch or the 3-position switch, wherein the shaft, the gear, and the cam spline are coaxially installed.

* * * * *